US005380263A

United States Patent [19]

Chung

[11] Patent Number: 5,380,263

[45] Date of Patent: Jan. 10, 1995

[54] WAIST SPORTING EQUIPMENT

[76] Inventor: Young B. Chung, A-102 Pacific House, 129-2 Anam-dong, Seongbuk-ku, Seoul, Rep. of Korea

[21] Appl. No.: 252,379

[22] Filed: Jun. 1, 1994

Related U.S. Application Data

[63] Continuation of Ser. No. 959,155, Oct. 9, 1992, abandoned.

[30] Foreign Application Priority Data

Jun. 9, 1992 [KR] Rep. of Korea ..... 92UM10203
Jun. 9, 1992 [KR] Rep. of Korea ..... 92UM10204

[51] Int. Cl.[6] ..... A63B 21/22
[52] U.S. Cl. ..... 482/110; 273/DIG. 19
[58] Field of Search ..... 482/110, 81; 273/DIG. 17, DIG. 18, DIG. 19

[56] References Cited

U.S. PATENT DOCUMENTS

| | | | |
|---|---|---|---|
| 1,851,433 | 3/1932 | Israel | 273/DIG. 17 |
| 3,352,340 | 10/1970 | Nardiello | 273/DIG. 19 |
| 3,425,690 | 2/1969 | Charbonnet | 482/110 |
| 3,509,660 | 5/1970 | Seymour | 482/110 |

FOREIGN PATENT DOCUMENTS

| | | | |
|---|---|---|---|
| 0909812 | 9/1972 | Canada | 273/DIG. 17 |
| 2242697 | 3/1974 | Germany | 273/DIG. 19 |

*Primary Examiner*—Richard J. Apley
*Assistant Examiner*—Lynne A. Reichard
*Attorney, Agent, or Firm*—Bradford E. Kile; Kevin M. O'Brien; Ruffin B. Cordell

[57] ABSTRACT

A waist sporting equipment has a circular ring member sized to encircle around the waist portion of a user and having a predetermined cross-section, an inertia member of a predetermined weight for applying the centrifugal force and inertia force gradually to the ring member upon rotation of the ring member, the inertia member including a weight body and connecting means for connecting the ring member and the inertia member for not separating the members upon the rotation of the members. The weight body is spaced a predetermined distance from the ring and applies the centrifugal force and the inertia force to the ring depending on the rotational velocity of the ring, thus giving a user various velocity and amusement feeling. Furthermore, the centrifugal force acts on the waist portion so that the waist may be stronger and limber and the body of the user may be well balanced.

8 Claims, 3 Drawing Sheets

WAIST SPORTING EQUIPMENT

This application is a continuation, of application Ser. No. 07/959,155, filed Oct. 9, 1992, abandoned.

BACKGROUND OF THE INVENTION

This invention relates to sporting equipment for waist exercise and amusement.

A conventional waist sporting equipment named "hula hoop" includes a circular ring for receiving the waist portion of a user. With rotation of the waist portion of the user, the circular ring is rotated. For the continuous rotation of the circular ring, the waist portion of the user should continuously rotate.

This conventional hula loop includes a hollow circular ring dimensioned to sufficiently maintain an inertia required for rotation of the circular ring encircling around the waist portion of the user. The size is about 1M.

The conventional hula loop has little effect on the waist exercise. Furthermore, the repetitive rotation of the hula hoop makes the user easily sick of the hula hoop.

In detail, the conventional hula hoop includes comparatively large and lightweight circular ring and may be simply rotated by a slight movement of the waist portion. The increase of the inertia with repetitive rotation of the hula hoop can not be expected since the hula hoop is light in weight. Therefore, a user may easily get sick of playing with the hula hoop.

Furthermore, the convention hula hoop has been of relatively expensive construction since a large-sized mold is required for making the conventional hula hoop of a comparatively large size. In addition, it is cumbersome to transfer or store the comparatively large hula-hoop to or in the desired place.

SUMMARY OF THE INVENTION

An object of the present invention is to provide waist sporting equipment wherein an exercise effect may be increased and a user may have an amusement feeling and a skill.

Another object of the present invention is to provide waist sporting equipment which is easy to manufacture and carry.

Still another object of the present invention is to provide waist sporting equipment of which operation is simple enough to be operated even by a child.

DESCRIPTION OF THE INVENTION

Figure 1:
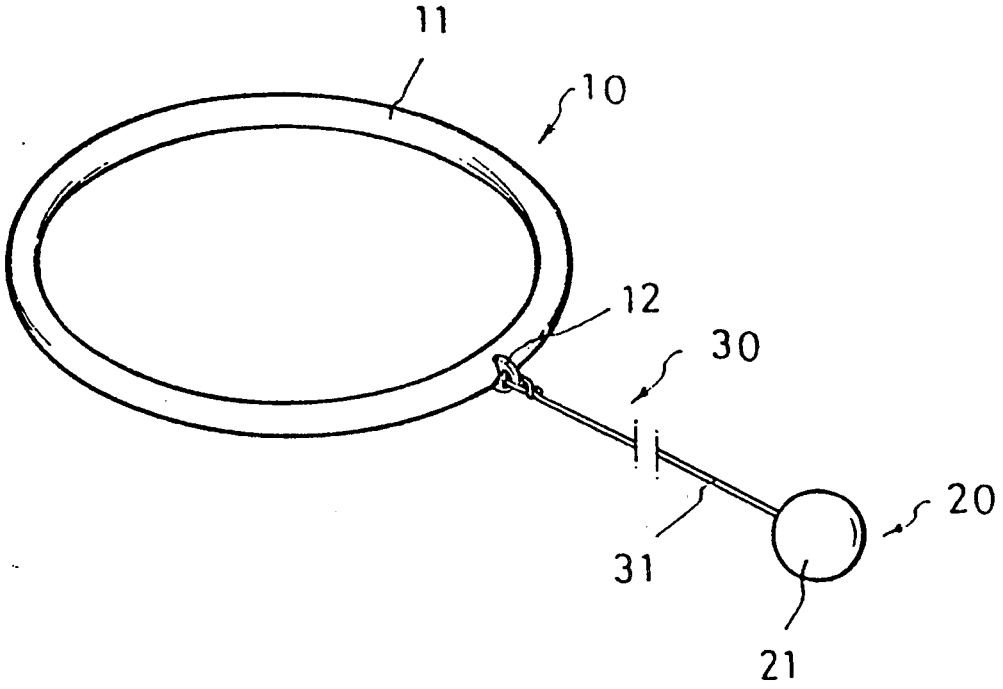
FIG. 1 is a perspective view of waist sporting equipment of the present invention.

Referring to the drawings, a ring member 10 includes a circular ring 1 having a predetermined cross-section and being adapted to encircle around the waist region of a user. An inertia member 20 includes a weight body 21 having a predetermined weight to apply the inertia force and the centrifugal force gradually to the ring member 10 when the ring member 10 is rotated. The ring member 10 is connected to the inertia member 20 by connector means 30.

The circular ring 10 has a diameter slightly larger that the waist size of the user and has a predetermined cross-section.

The circular ring 11 is molded by plastic material to have a circular, sexangular or octagonal shape in cross-section. Preferably, as shown in the drawings, the circular ring 11 has a circular cross-section at a portion in contract with the waist portion of the user in consideration of smoothness and frictional resistance between the waist portion.

The circular ring 11 may be a hollow or a filled one. The difference between a conventional hula hoop and the circular ring of the present invention is that the circular ring of the present invention is smaller than the conventional hula hoop at the diameter thereof.

Preferably, the circular ring member 10 has an inside diameter of about 50 cms which is sufficient to prevent the waist portion from being caught by the circular ring member 10.

The circular ring 11 is half the size of the conventional hula hoop and comparatively smaller, thus requiring a comparatively smaller mold when manufacturing the circular ring 11. Accordingly, the manufacture cost of the circular ring 11 is low and the transfer of the ring 11 to a desired place is easy.

The inertia member 20 is connected to the ring member 10 and adapted to apply an inertial force to the ring 11 when the waist rotates, whereby the movement of the waist will be accelerated as the rotation speed of the ring member 10 is increased.

The weight body 21 is spaced a predetermined distance from and is rotated simultaneously with the circular ring 11, thus producing a centrifugal force outwardly from the center of the ring member 20. A velocity component is produced perpendicular to the centrifugal force causing the inertia force to be increase gradually.

The weight body 21 may be preferably of a conventional ball made of rubber or plastic material for preventing an accident which may be caused when the weight body 21 impacts on other persons or objects during rotation.

The weight body 21 may have such weight as to enable the weight body 21 to be neither faster nor slower than the ring member 11, and to enable the weight body 21 to rotate simultaneously with the ring member 10. For this purpose, the weight of the weight body 21 is obtained through a test. The size and configuration of the weight body 21 does not affect the operation of the body 21. However, for convenient storing, the weight body 21 may be preferably of a ball shape such as a tennis ball.

Through the connector means 30, the ring member 10 and the inertia member 20 are rotated simultaneously.

The connector means 30 includes a string 31 having one end attached to the ring member and another end attached to the weight body 21.

Figure 2:
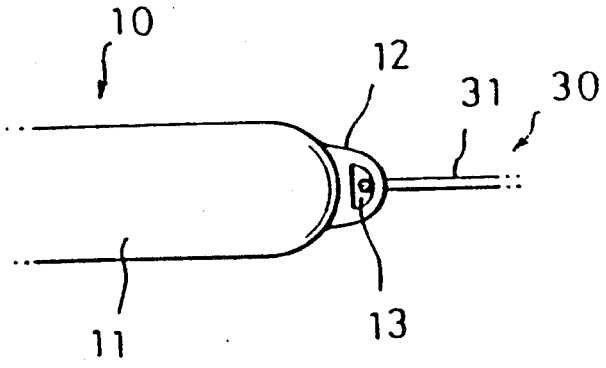
FIG. 2 is a fragmented front view of components showing the connecting means mounted on the circular ring.
Figure 3:
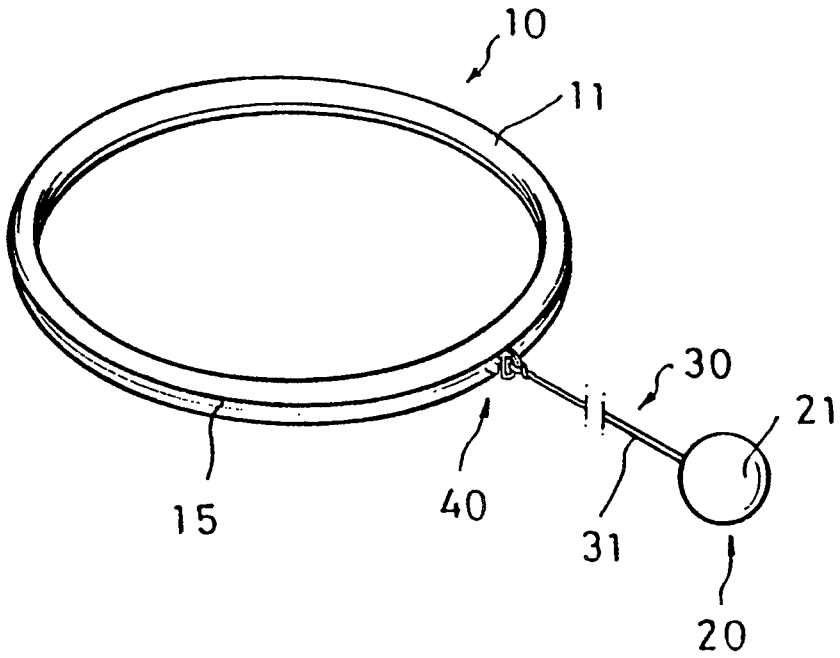
FIG. 3 is another embodiment of the waist sporting equipment of the present invention.
Figure 7:
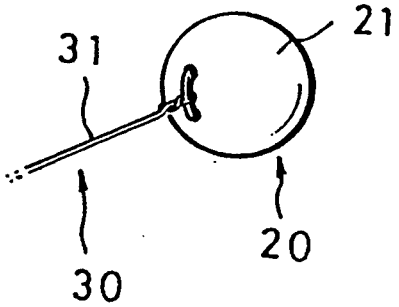
FIG. 7 is a perspective view showing the weight body connected to the connecting means.

As shown in FIG. 2, a rib 12 is affixed to the circular ring 11 and has an aperture 13 for engaging one end of the string. As shown in FIG. 7, the other end of the string 31 is directly affixed to the weight body 21.

The particular method of affixing the string 31 to the weight body 21 and to the ring 11 embodied herein departing from the spirit of the present invention. Therefore, such apparent alternatives as, for example, affixing the string 31 directly to the periphery of the ring 11 without providing the rib 12, and providing a rib on the weight body 21 for fixing of the string are included within the scope of the present invention.

Generally, the string 31 does not change lengthwise so that the weight body 21 will maintain a predetermined distance from the waist portion when the weight body 21 is rotated.

In case a resilient string made of rubber material which is changable lengthwise, or a coiled spring having comparatively small diameter (not shown) is utilized as the connector means 30, the velocity of the weight body 21 increased upon rotation of the body 21, thus increasing the centrifugal force. The resilient string or the coiled spring will lengthen in proportion to the centrifugal force, thus varying the distance between the waist portion and the weight body 21. With this arrangement, the user may have a feeling of various rotating velocity and amusement.

When the inertia force is added to the various rotating velocity, the centrifugal force may be increased. Accordingly, gradual strong pressure may be applied to the waist portion by the centrifugal force of the ring 11, thus achieving both an effective waist sport and a weight losing loss of the user.

Rotatory means 40 may be mounted between the connector means 30 and the ring 11 for rotating the weight body 21 in the direction perpendicular to the centrifugal force of the inertia member 20 and around the periphery of the ring member, thus obtaining more of a dynamic effect on sports and playing.

As shown in FIGS. 3 through 6, the rotatory means 40 permits the connector means 30 connected at one end thereof to the inertia member 20, to move by the guidance of the ring 11. With this arrangement when the ring 11 encircling around the waist portion of the user is rotated while being gradually applied by the inertia, the inertia member 20, the connector means 30 and the rotatory means 40 are rotated circularly without affecting the rotating velocity of the ring 11.

As described above, when the ring 11 and the connector means 30 are connected together by the rotatory means 40, at the beginning, the rotating inertia force of the ring 11 may always be different from the inertia of the inertia member 20, by the difference between the diameter of the ring 11, and the distance from the center of the respective ring 11 to the center of the inertia member 21. With this arrangement, it requires a great deal of skill to rotate the ring member 10 without stopping the ring member 10 inadvertently during rotation.

There may be barious conditions that differentiate the rotating velocity of the ring 11 and that of the inertia member 20, such as frictional resistance between the rotatory means 40 and the ring 11, weight of the respective ring 11 and the inertia member 20 and difference of movement of the waist. Despite the conditions, it requires skill to conform the rotating velocity of the ring 11 to that of the inertia member 20. A resultant force by the conformity of the velocity will enable the rotation of the ring 11 and of the inertia member 20 to be gradually increased.

The decrease of those velocity will cause the rotatory means 40 to decrease, by the guidance of the ring 11, a frictional resistance even when the movement of the waist portion stopped. With the decrease of the frictional force, the inertia member 20 will not stop suddenly but make a slow stop. That is, the inertia member 20 may be permitted to adjust its rotating velocity.

Figure 4:
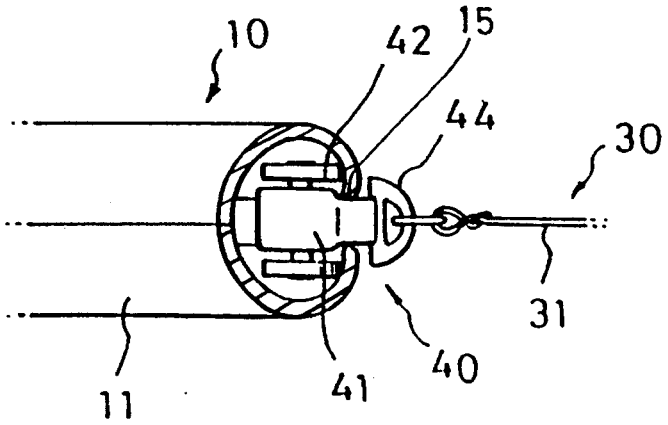
FIGS. 4 to 6 show other embodiments of the rotatory means shown in FIG. 3.

FIG. 4 shows one embodiment of the rotatory means 40. In the embodiment 5, a hollow ring 11 is provided and has a peripheral groove 15. The rotatory means 40 includes a pair of rollers 42 mounted on a support 41. The upper and lower rollers 42 ride in the groove 15 for facilitating the rotation of the rotatory means 40.

For facilitating the provide the peripheral groove 15 in the ring 11 shown in FIG. 4, symmetrical upper and lower ring portions are made separately and then are joined together at the intermediate portions thereof.

Figure 5:
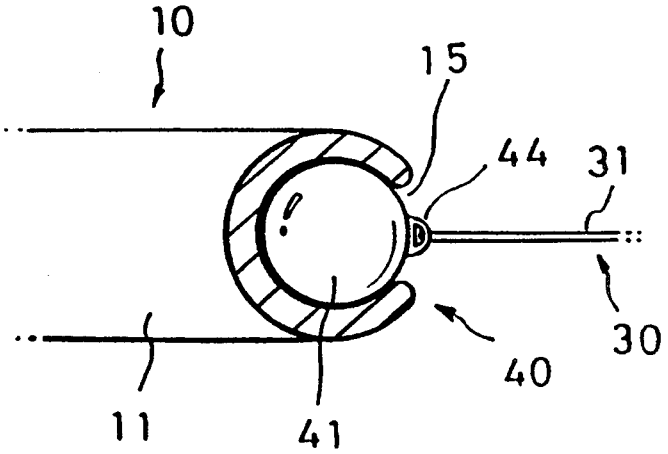

FIG. 5 shows another embodiment of the rotatory means 40. In the embodiment, the support 41 is in the shape of a ball serving as bearing. With this ball-shaped support 41, a frictional force may be decreased by a point contact.

Figure 6:
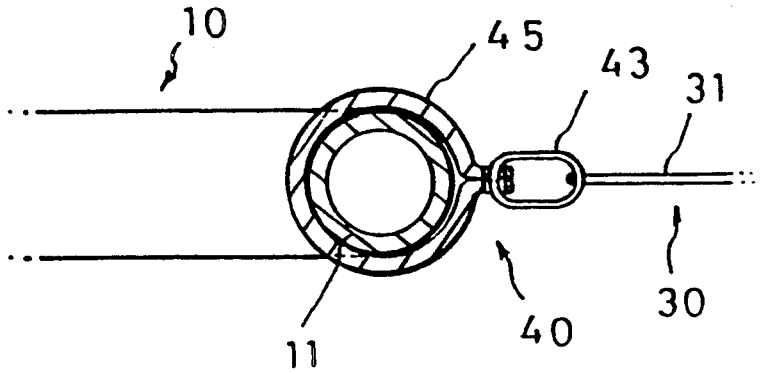

FIG. 6 is still another embodiment of the rotatory means 40. A larger ring 45 encircles around the periphery of the ring 11, the larger ring 45 having a diameter slightly larger than the ring 11. With this arrangement, the rotation of the rotatory means 40 may be facilitated by a point contact of the facing faces of the ring 11, 45 when the inertia force is acted. In this embodiment, the ring 11 has a circular cross-section without having a groove. Preferably, a hollow ring 11 maybe utilized for material saving.

As described-above, this invention includes a weight body spaced a predetermined distance from a circular ring body spaced a predetermined distance from a circular ring for applying the centrifugal force and inertia force depending on the rotational speed. With this arrangement the user may have a various velocity and amusement feeling by adjusting the velocity of the rotation of the circular ring. The centrifugal force may act on the waist portion so that the waist will be stronger and limber and the body will be well balanced. Furthermore, the movement of the connecting member connecting the inertia member to the ring member may permit the user to easily play with the circular ring of this invention without any particular skill.

I claim:

1. A waist sporting and amusement device comprising:

a circular ring member sized to encircle around the waist portion of a user and having a cross-section with an upper arcuate portion and a lower arcuate portion such that said upper arcuate portion extends from a first inner circumferential location to a second outer circumferential location and terminating at said second outer circumferential location with an interior edge and said lower arcuate portion extends from said first inner circumferential location to a third outer circumferential location and terminating at said third outer circumferential location with an interior edge whereby a peripheral groove is formed and defined by said interior edges of said upper arcuate portion and said lower arcuate portion;

an inertia member of a predetermined weight for applying centrifugal force and inertia force gradually to said circular ring member upon rotation of said ring member, said inertia member including a weight body;

connecting means for connecting the ring member and the weight body so that the weight body may rotate with respect to the ring member upon rotation of the inertia member; and rotary means for attaching said connecting means to said circular ring, said rotary means including a support body positioned within said circular ring, said support body including a body portion and a stem portion having a bearing surface, said stem portion projecting through said peripheral groove such that said bearing surface operably interacts with said interior edges of said upper and lower arcuate portions so as to provide for controlled movement of said support body;

a connecting rib secured to said stem portion of said support body for connecting said connecting means to said support body;

upper and lower rollers journaled for rotation from said body portion of said support body and each of said upper and lower rollers operably contacting only a circumferential portion of the interior surface of said upper and lower arcuate portions of said circular ring member respectively to facilitate travel of said support body about the interior of said upper and lower arcuate portions of said circular ring as a user employs a rocking action of the user's waist to effect rotation of said inertia member about said circular ring for sport and amusement.

2. A waist sporting device according to claim 1, wherein the weight body of the inertia member has a flexible and resilient surface.

3. A waist sporting equipment according to claim 1, wherein the weight body of the inertia member is a hollow body.

4. A waist sporting device according to claim 1, wherein the connecting means is a string which is not changable lengthwisely.

5. A waist sporting equipment according to claim 1, wherein the connecting means is of a resilient material which is changably lengthwisely.

6. A waist sporting equipment according to claim 5, wherein the connecting means is an elastic cord.

7. A waist sporting equipment according to claim 5, wherein the connecting means is a coiled spring.

8. A waist sporting device according to claim 1 wherein said connecting means is resilient and is capable of a change in length as the inertia member is rotated about said circular ring member.

* * * * *